United States Patent [19]

Wardlaw et al.

[11] Patent Number: 4,966,816

[45] Date of Patent: Oct. 30, 1990

[54] PACK ASSEMBLY FOR HOT ROLLING

[75] Inventors: Tommie L. Wardlaw, Henderson; Paul J. Bania, Boulder City, both of Nev.

[73] Assignee: Titanium Metals Corporation of America (TIMET), Pittsburgh, Pa.

[21] Appl. No.: 362,511

[22] Filed: Jun. 7, 1989

[51] Int. Cl.[5] ..... B22F 3/00

[52] U.S. Cl. ..... 428/552; 428/628; 428/629; 428/632; 428/636; 428/660; 428/472; 29/559

[58] Field of Search ..... 428/552, 628, 629, 632, 428/636, 660, 472; 29/559

[56] References Cited

U.S. PATENT DOCUMENTS

| | | | |
|---|---|---|---|
| 1,956,818 | 5/1934 | Acre | 428/632 |
| 2,786,265 | 3/1957 | Keay, Jr. | 428/660 |
| 2,813,332 | 11/1957 | Keay, Jr. | 428/660 |
| 2,932,885 | 4/1960 | Watson | 428/660 |
| 3,086,284 | 10/1959 | Schetky | 428/632 |
| 3,652,237 | 3/1972 | Mizuhara | 428/660 |
| 3,754,874 | 8/1973 | Anderson | 428/636 |
| 4,743,512 | 5/1988 | Marlowe et al. | 428/552 |
| 4,808,487 | 2/1989 | Gruenr | 428/610 |
| 4,839,242 | 6/1989 | Murayama et al. | 428/660 |

*Primary Examiner*—Stephen J. Lechert, Jr.
*Assistant Examiner*—Leon Nigohosian, Jr.
*Attorney, Agent, or Firm*—Finnegan, Henderson, Farabow, Garrett & Dunner

[57] ABSTRACT

A pack assembly for use in hot rolling a material sensitive to heat loss, such as gamma titanium aluminide. The pack assembly has a pair of opposed deformable metal cover plates adjacent opposite outer major surfaces of at least one flat product of the material to be hot rolled positioned between the cover plates. A continuous thermal barrier is positioned between each of the outer major surfaces of each of the cover plates.

6 Claims, 1 Drawing Sheet

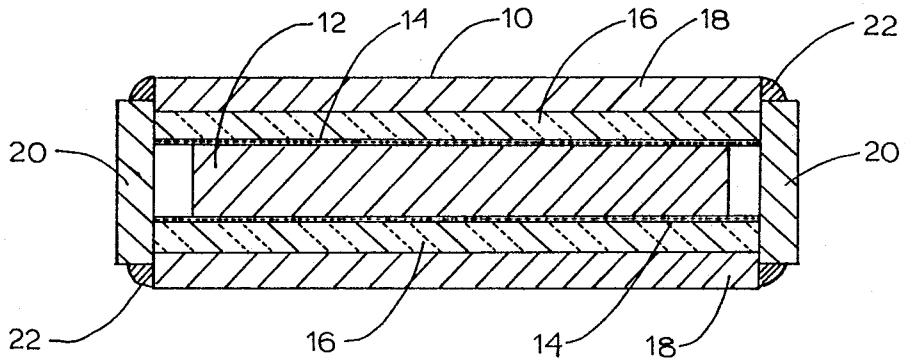
22
20
18
16
10
14
12
20
22
18
14
16

PACK ASSEMBLY FOR HOT ROLLING

BACKGROUND OF THE INVENTION

1. Field of the Invention

This invention relates to a pack assembly for use in hot rolling a material sensitive to heat loss, such as gamma titanium aluminide.

2. Description of the Prior Art

For various applications where high strength-to-weight ratios are required at elevated temperatures, such as jet engine and air frame applications, it is known to employ gamma titanium aluminides. These materials include a titanium-aluminum intermetallic compound of gamma titainium aluminide and may comprise titanium in combination with 31–35 weight percent aluminum with optional additions of beta stabilizers, such as vanadium, chromium, molybdenum, tungsten, tantalum, niobium, and manganese within the range of 0.25 to 12%.

Although gamma titanium aluminide alloys find useful application in the form of flat-rolled product, such as sheet, plate and foil, they are deformation temperature sensitive in that they tend to crack upon deformation, such as by rolling, if proper elevated temperatures are not maintained. The common practice used to produce these flat rolled products from conventional titanium alloys is to forge an ingot of the alloy to a slab and hot roll the slab to a thin gage, for example 0.020 to 0.25 inch thicknesses. When thicknesses are below approximately 0.2 inch a common practice is to use a 'pack rolling ' method whereby steel cover plates and side bars are welded together around the titanium workpiece(s). This practice helps to minimize the radiant heat loss and conductive heat loss caused by the use of cold (less than 300° F.) rolls which are considerably lower in temperature than the workpiece. The hot working temperature employed during these operations is usually dictated by the beta transus temperature of the particular alloy composition. Most conventional titanium-base alloys have beta transus temperatures within the range of 1700° to 1900° F. and consequently typical working temperatures for these alloys are within the range of 1500° to 2100° F. Gamma titanium aluminide alloys, however, have beta transus temperatures within the range of 2400° to 2550° F., and thus require much higher than typical hot working temperatures. In addition, it is known that maintenance of these high temperature during rolling is important.

The problems of working gamma titanium aluminides by conventional hot working practices therefore include the practical temperature limitations of the furnaces employed for heating to hot rolling temperature, the cooling effect imparted to the alloy during hot rolling by the work rolls of the rolling mill and natural radiant heat loss.

Consequently, with conventional hot-rolling techniques gamma titanium aluminides are subject to cracking during the hot rolling operation, particularly when hot rolled to relatively thin gages where greater heat losses occur. Also due to the high working temperatures required for rolling gamma titanium aluminides, conventional pack materials (such as steels) are not useful due to the eutectic reaction which occurs when titanium is in contact with iron or nickel based materials above about 2000° F. Thus, a non-reactive pack material is also required, in addition to a pack construction which minimizes heat loss.

SUMMARY OF THE INVENTION

It is accordingly a primary object of the present invention to provide a pack assembly for use in hot rolling materials sensitive to heat loss, such as gamma titanium aluminides, that permits hot rolling by conventional practices to relatively thin gages while avoiding cracking of the material due to heat loss while avoiding undesirable reactions between the workpiece and cover material.

A more specific object of the invention is to provide a pack assembly for use in hot rolling materials sensitive to heat loss wherein the cooling effect of work rolls of the hot rolling mill during hot rolling of the material is minimized to avoid cracking of the material during hot reduction thereof.

In accordance with the invention, there is provided a pack assembly for use in hot rolling a material sensitive to heat loss, which may be termed deformation temperature sensitive, such as gamma titanium aluminide. The pack assembly includes a pair of opposed, deformable metal cover plates adjacent opposite outer major surfaces of at least one flat product of the material to be hot rolled positioned between the cover plates. A continuous thermal barrier is positioned between each of the outer major surfaces and each of the cover plates.

The pack assembly may include deformable metal side members attached to and connecting opposite edges of the cover plates to enclose opposite edge portions of the flat product. The flat product may be coated with a separating medium on its major surfaces to facilitate separation thereof from the pack upon the completion of hot rolling.

The cover plates of the pack assembly may comprise a titanium-base alloy consisting essentially of, in weight percent, 14 to 20 molybdenum, 1.5 to 5.5 niobium, up to 3.5 aluminum, 0.15 to 0.55 silicon, up to 0.25 oxygen and balance titanium and incidental impurities. A composition within these ranges used as cover plates will exhibit deformation at hot rolling temperatures similar to or substantially the same as conventional gamma titanium aluminides, thereby facilitating hot deformation of the pack during hot rolling and thus reduction of the flat gamma titanium aluminide product during the hot rolling operation.

BRIEF DESCRIPTION OF THE DRAWING

The single FIGURE of the drawing is an embodiment of a pack assembly in accordance with the invention constituting a sectional view thereof.

DETAILED DESCRIPTION OF THE PREFERRED EMBODIMENT

With reference to the single FIGURE of the drawing, there is shown a pack assembly in accordance with the invention designated generally as 10. The pack assembly includes a flat product, which may be termed as a slab or plate 12 of the material to be hot rolled, which may be a deformation temperature sensitive material, such as gamma titanium aluminide. The product 12 has on opposite major surfaces thereof a coating of a separating medium compound 14, which may be calcium oxide, titanium oxide, zirconium oxide, boron nitride or magnesium oxide. This separating medium coating facilitates separation of the product 12 from the pack upon the completion of hot rolling.

A mat 16 is positioned on opposite major surfaces of the product 12. The mat is of a heat insulating material and constitutes a thermal barrier with respect to the product 12. This mat may be of any conventional heat insulating material such as a composite of alumina and silica fibers. Other suitable thermal barrier layers may be employed such as ceramic cloth or fiberboard.

In accordance with the invention, the thermal barrier should have a thickness of at least 0.01 inch and a thermal conductivity less than 10 BTU.in/hr.ft$^2$.° F.

The pack further includes a pair of opposed, deformable metal cover plates 18. The cover plates should be of a material that is deformable under the specific hot rolling conditions, particularly temperature and roll separating force, employed during the hot rolling of the pack assembly. The deformable plates should desirably undergo a thickness reduction during hot rolling similar to or substantially the same as the deformation temperature sensitive product of the pack.

The pack further includes metal side members 20 which are attached to and connect opposite edges of the cover plates 18 and are welded thereto as at 22.

A material particularly adapted for use in the manufacture of the cover plates is a titanium-base alloy within the compositional limits, in weight percent, of 14 to 20 molybdenum, 1.5 to 5.5 niobium, up to 3.5 aluminum, 0.15 to 0.55 silicon, up to 0.25 oxygen and balance titanium and incidental impurities. A material within these composition limits will have substantially the same hot deformation properties as typical gamma titanium aluminides within a hot-rolling temperature range of 2100° to 2550° F.

The pack assembly as shown in the drawing and described above is heated in a conventional furnace and rolled to the required final dimensions for converting the flat product 12 to sheet, plate or foil.

During conventional hot rolling of a pack assembly as described above and shown in the FIGURE hot rolling of gamma titanium aluminide product from 1 inch thick workpieces to final thicknesses of about 0.03 inch was achieved without cracking by the use of a series of pack reductions, with each achieving about a 50% reduction in gage.

Upon completion of hot rolling to reduce the flat product 12 to the desired gage, the flat product is removed from the pack by peeling away of the pack components.

The term metal as used in the specification and claims is intended to include metal alloys.

In the specification and claims, all parts and percentages are by weight percent unless otherwise specified.

What is claimed is:

1. A pack assembly for use in hot rolling a material sensitive to heat loss, such as gamma titanium aluminide, said pack assembly comprising a pair of opposed, deformable metal cover plates adjacent opposite outer major surfaces of at least one flat product of said material positioned between said cover plates, and a continuous thermal barrier positioned between each of said outer major surfaces and each of said cover plates.

2. The pack assembly of claim 1 including deformable metal side members attached to and connecting opposite edges of said cover plates to enclose opposite edge portions of said flat product.

3. The pack assembly of claim 2 wherein said flat product, is coated with a separating medium.

4. The pack assembly of claim 1 or claim 2 wherein said cover plates comprise a titanium-base alloy consisting essentially of, in weight percent, 14 to 20 molybdenum, 1.5 to 5.5 niobium, up to 3.5 aluminum, 0.15 to 0.55 silicon, up to 0.25 oxygen and balance titanium and incidental impurities.

5. The pack assembly of claim 4 wherein said flat product is coated with a separating medium.

6. The pack assembly of claim 4 wherein said continuous thermal barrier is a mat of heat insulating material.

* * * * *